US007255041B2

(12) United States Patent
Riedel

(10) Patent No.: US 7,255,041 B2
(45) Date of Patent: Aug. 14, 2007

(54) CYLINDER AND DEVICE FOR GUIDING A MATERIAL WEB

(75) Inventor: Uwe Johann Riedel, Dirmstein (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 183 days.

(21) Appl. No.: 10/511,444

(22) PCT Filed: Dec. 22, 2003

(86) PCT No.: PCT/DE03/04237

§ 371 (c)(1),
(2), (4) Date: Oct. 26, 2004

(87) PCT Pub. No.: WO2004/085155

PCT Pub. Date: Oct. 7, 2004

(65) Prior Publication Data

US 2005/0199144 A1 Sep. 15, 2005

(30) Foreign Application Priority Data

Mar. 26, 2003 (DE) ..... 103 13 444

(51) Int. Cl.
*B41F 9/06* (2006.01)
*B41F 13/10* (2006.01)

(52) U.S. Cl. ..... 101/153; 101/152; 101/216; 101/375; 492/16; 492/18

(58) Field of Classification Search ..... 101/152–153, 101/375–376, 212, 216, 219; 492/16, 18
See application file for complete search history.

(56) References Cited

U.S. PATENT DOCUMENTS

| | | | | |
|---|---|---|---|---|
| 3,389,450 | A | 6/1968 | Robertson | |
| 3,638,292 | A | 2/1972 | Gaghan | |
| 3,838,480 | A * | 10/1974 | Depuy | 26/104 |
| 4,438,695 | A | 3/1984 | Maier et al. | |
| 4,455,727 | A | 6/1984 | Tschirner | |
| 4,856,155 | A * | 8/1989 | Niskanen et al. | 492/5 |
| 4,905,598 | A | 3/1990 | Thomas et al. | |
| 4,913,051 | A | 4/1990 | Molinatto | |
| 5,813,960 | A | 9/1998 | Schnyder | |
| 6,758,139 | B2 | 7/2004 | Knoll | |
| 6,786,151 | B2 * | 9/2004 | Stiel | 101/335 |
| 2003/0010150 | A1 | 1/2003 | Glockner et al. | |

FOREIGN PATENT DOCUMENTS

| | | |
|---|---|---|
| DE | 1264378 | 3/1968 |
| DE | 3033230 A1 | 3/1982 |
| DE | 3033230 C2 | 3/1982 |
| DE | G 88 08 352.7 | 9/1988 |
| DE | 196 54 199 | 7/1998 |
| DE | 199 63 945 | 7/2001 |
| DE | 100 23 205 | 11/2001 |
| EP | 0 331 870 | 3/1988 |
| EP | 0 741 253 | 11/1996 |

* cited by examiner

*Primary Examiner*—Daniel J. Colilla
*Assistant Examiner*—Marissa Ferguson-Samreth
(74) *Attorney, Agent, or Firm*—Jones, Tullar & Cooper, P.C.

(57) ABSTRACT

The invention relates to a cylinder, which is in contact with a material web. Said cylinder flexes in or against the direction of travel of the material web, in accordance with at least one pixel that is located on said web.

11 Claims, 13 Drawing Sheets

23

27; 28; 29

CYLINDER AND DEVICE FOR GUIDING A MATERIAL WEB

CROSS-REFERENCE TO RELATED APPLICATIONS

This application is the U.S. National Phase, under 35 USC 371, of PCT/DE 2003/004237, filed Dec. 22, 2003; published as WO 2004/085155 A1 on Oct. 7, 2004 and claiming priority to DE 103 13 444.1 filed Mar. 26, 2003, the disclosures of which are expressly incorporated herein by reference.

FIELD OF THE INVENTION

The present invention is directed to a cylinder, as well as to a device for guiding a web of material. The cylinder is bent with respect to the web travel direction in response to an image of the web.

BACKGROUND OF THE INVENTION

Pairs of cylinders are frequently employed as tools for guiding webs of material, or for processing their surfaces. The cylinders are rotatably arranged with pivotable shafts and delimit a gap through which the web of material runs. Along a clamping line which is parallel with the shafts, the web is subjected to a pressure from a cylinder, which pressure exerts a guiding pressure or effect on the web of material, or performs web processing. This pressure must be evenly distributed over the length of the clamping line to assure that the processing is even over the width of the web and, with guiding rollers, to prevent irregularities of any slippage occurring between the rollers and the web over the width of the web, which irregularities can lead to a deformation of the web per se. Such a deformation can be the source of indexing errors when printing on the web.

An important reason for the occurrence of irregularities in the print distribution along the clamping line is the inherent deformation of the rollers because of their own weight. It is known, for example, that the forme cylinders for rotogravure printing, in particular forme cylinders of a great width, of an order of magnitude between 1.5 m to 4 m, have a tendency to sag under their own weight. Because of this cylinder sag, the pressure along the clamping line between such a forme cylinder and a counter-pressure cylinder, which is arranged above it, is reduced toward the center of the paper web. For this reason, the counter-pressure cylinder of known rotogravure printing presses is also bent to match the outer shape of the counter-pressure cylinder to the bending of the forme cylinder, and to distribute the pressure between the two cylinders evenly over the clamping line.

A counter-pressure cylinder for a rotogravure press is known from DE 30 33 320 C2, and whose shell is received, rotatably seated, in rolling bearings in the area of its ends, in adjustable bearing end plates. An actuating member, which is supported on the associated adjustable bearing end plate, and which can be actuated in the radial direction with respect to the shaft, acts on the ends of the cylinder shaft, which shaft extends through the shell and protrudes from the shell. The shell of the counter-pressure cylinder is bent by operation of the actuating member, and the counter-pressure cylinder exterior shape is matched to the shape of a forme cylinder, which has been placed against it.

A counter-pressure cylinder, which cooperates with a forme cylinder in a rotogravure printing press, is also known from DE 100 23 205 A1. A variable matching of the counter-pressure cylinder to the forme cylinder is achieved with this counter-pressure cylinder. A linear drive mechanism, which is located at each of the ends of the counter-pressure cylinder, and between a fixed shaft and a rotating shell, acts, in a vertical radial direction, downwardly on an inner ring of a rolling bearing, while the center area of the shells is maintained rotatably, but not displaceably, on the shaft.

DE 88 08 352 U1 discloses a cylinder, whose bending can be adjusted in two planes.

U.S. Pat. No. 3,638,292 and EP 0 741 253 A2 show contact pressure rollers, which have wheels in their interior, and which can be charged with a pressure medium. These wheels are arranged on a common shaft.

U.S. Pat. Nos. 4,455,727 and 3,389,450 disclose rollers, which can be bent in two planes that are offset by 90°. Actuating elements are arranged in the interior of the rollers.

A cylinder with an assembly for generating an inner tension of the cylinder, and with a control unit/regulator for controlling the assembly, and with vibration sensors, is known from DE 199 63 945 C1. The assembly and actuating members are controlled in response to the vibrations detected by the vibration sensor.

A counter-pressure cylinder is also known from U.S. Pat. No. 4,913,051, which counter-pressure cylinder consists of a shaft and of a shell which can be rotated around the shaft. Inflatable chambers are provided between the shaft and the shell of this counter-pressure cylinder. The chambers will expand or extend, after being charged with pressure, and will thus cause bending of the shell.

EP 0 331 870 A2 discloses an arrangement for the seating of cylinders. Journals of a cylinder are seated in two bearings that are arranged side-by-side in the axial direction of the cylinder. The bearings can be individually moved perpendicularly with respect to the axis of rotation by the use of pressure medium cylinders in order to compensate for bending, for example.

An exact guidance of a web, in a manner which is free of indexing errors, is made difficult, particularly in connection with rotogravure printing presses of great width, because it is extremely difficult to produce forme cylinders, also of great length, and which have an exactly constant diameter over their length. In most cases, such a long forme cylinder is slightly thicker in its center than it is at its edges or ends. A traction force, which is exerted between the forme cylinder and a counter-pressure cylinder, on a web passed through between them, is therefore typically greater in the center of the web than it is at the edges of the web.

As a result of this uneven traction force, an uneven tension profile is generated within the paper web over its width. Since, in the course of the paper webs being processed in such a press, the paper webs absorb moisture, their stretching ability increases, so that an uneven stretching of the web, in accordance with the uneven tension profile, can occur. The result can be indexing errors.

Indexing errors between the center of the web, and an edge of the web, can be compensated for with the aid of an inlet roller, which is arranged staggered between two pressure gaps. However, in this case, it is disadvantageous that, on the other side of the paper web, the indexing errors become even greater, and that there is a danger of a lateral drift-off of the paper web.

The present invention creates a symmetrical tension profile in the web of material, which symmetrical tension profile increases toward either the center or toward the web edge areas and, in the areas of high tension, creates a change in web length, in the elastic range of the paper web. In this way, the invention provides the possibility of adjusting the image points of the different colors to be imprinted on the web, without letting the paper web drift off toward one side.

SUMMARY OF THE INVENTION

The object of the present invention is directed to the provision of a cylinder, as well as to a device for guiding a web of material.

In accordance with the present invention, this object is attained by the provision of a cylinder, which is contacting a web of material, the cylinder having a bend either in, or opposite to the running direction of the web of material. The bend is imparted to the cylinder as a function of at least one image element on the web. The cylinder, and a second cylinder placed against it, can form a gap through which the web passes. The web is clamped along a clamping line defined by the cooperation of the two cylinders. That clamping line can be curved either in, or in opposition to, the web travel direction.

The advantages to be obtained by the present invention consist, in particular, in that the device makes it possible, in an easy manner, to make the effective path of the web of material, for example the effective path of a paper web, variable over the width of the paper web from a fixed point, such as from a guide roller that is located upstream of the gap, to a fixed point that is located downstream of the gap. The inhomogeneity of the web tension which results from this variability of the path length, can be set in such a way that it exactly compensates for an inhomogeneity caused by the thickening of the forme cylinder. In this way, the stretching of the web can be made uniform over its entire width. A printing of the web, which is free of indexing errors, becomes possible over the entire width of the paper web.

A cylinder shaft in accordance with the present invention preferably has a device, around which a first cylinder can be rotated, two end sections and a center section, which shaft and its sections support the first cylinder at its ends, or in the center. At least one actuating member is arranged on the shaft for shifting the end sections and the center section with respect to each other in a direction which is vertical with respect to the shaft of the first cylinder, and in this way to bend the first cylinder. If the displacement direction of the actuating member forms an angle with a plane defined by the shaft of the first cylinder and by the shaft of the second cylinder, the actuating member also can cause or effect the curvature of the clamping line, which is required by the present invention.

The actuating direction of this at least one actuating member is preferably rotatable around the shaft of the first cylinder.

It is also possible, in accordance with the present invention, to provide at least two actuating members, which shift the sections of the shaft, with respect to each other, in different directions. These different directions preferably form a right angle. A total displacement of the sections of the shaft in a direction, which forms an arbitrary angle with the plane of the cylinder shafts and which is a function of the amounts of the individual shifting, results from the superimposition of the shifting in these two directions.

The actuating direction of one of these two actuating members is preferably located in the plane of the shafts.

An end section projects, in a preferred manner, from each end of each of the first cylinders. At least one of the actuating members is arranged outside of the cylinder on at least one of these end sections.

With the aid of diametrically opposed actuating members, it is possible to cause a curvature of the clamping line. This curvature can be caused both with a center section which is deflected in the running direction of the web of material, as well as with a center section deflected against the running direction of the web of material.

At least one of the actuating members can be a set screw.

It is also possible to configure one of the actuating members as a hydraulic actuating member.

The device in accordance with the present invention advantageously contains at least one bearing, for example a rolling bearing, between the first cylinder and the shaft.

Also advantageously, the cylinder has a rubber surface. The resilience of the cylinder rubber surface makes it easier to set an even pressure distribution along the clamping line.

In an advantageous manner, in accordance with the present invention, the actuating members are in contact with a circulating device for a coolant or a lubricant. In this case, at least one seal element should be provided at the actuating members.

The second cylinder preferably is a forme cylinder.

In a particularly preferred manner, the device is a part of a rotogravure printing press.

A length of the first cylinder of the present invention is quite particularly preferred to lie between 1.5 m and 4 m, so that webs of material of a corresponding width can be processed with the device.

BRIEF DESCRIPTION OF THE DRAWINGS

Preferred embodiments of the present invention are represented in the drawings and will be described in greater detail below.

Shown are in.

DESCRIPTION OF THE PREFERRED EMBODIMENTS

Figure 1:
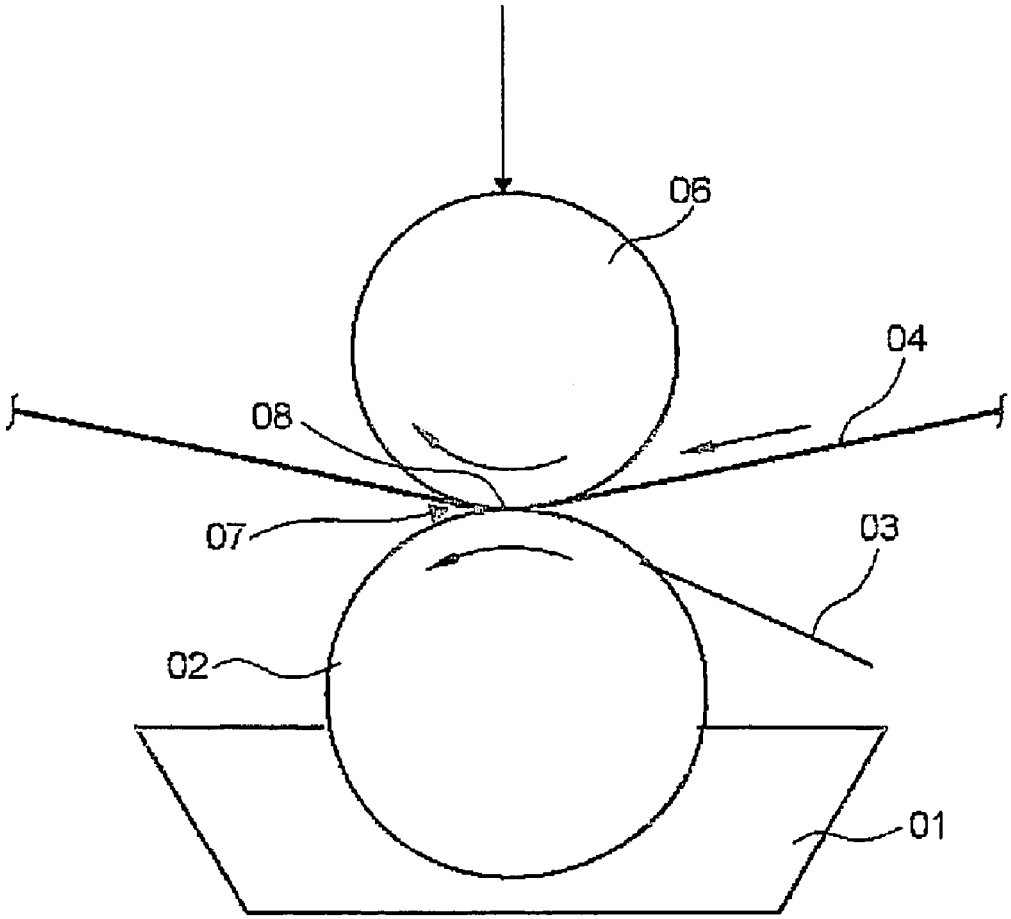
FIG. 1, a side elevation view of a printing group of a rotogravure printing press in a schematic representation, in FIG. 2, a schematic front elevation view of the cylinders of the printing group and depicting an exaggerated cylinder bending, in FIG. 3, a side elevation view of a printing group, in FIG. 4, a longitudinal cross-sectional view through a counter-pressure cylinder, in FIG. 5, a first perspective representation of a bearing of the counter-pressure cylinder, in FIG. 6, a second perspective representation of a bearing of the counter-pressure cylinder, in FIG. 7, a view, taken along a section line A-A through the bearing represented in FIG. 5, in FIG. 8, a side elevation view of a printing group from FIG. 3, in FIG. 9, a side elevation view with a modification of the printing group, in FIG. 10, a longitudinal sectional view through an alternative counter-pressure cylinder, in FIG. 11, a further longitudinal sectional view through an alternative counter-pressure cylinder, in FIG. 12, a schematic longitudinal sectional view through the alternative counter-pressure cylinder in a view from above, in FIG. 13, an actuating member in a perspective representation, in FIG. 14, an enlarged portion of the longitudinal sections represented in FIGS. 10 and 11, in FIG. 15, a cross-sectional view through the counter-pressure cylinder at the level of an actuating member, in FIG. 16, a depiction of the effects of different degrees of bending on a web of material having image elements, and in FIG. 17, a schematic representation of a roller with a curvature in the running direction of a web of material.
Figure 2:
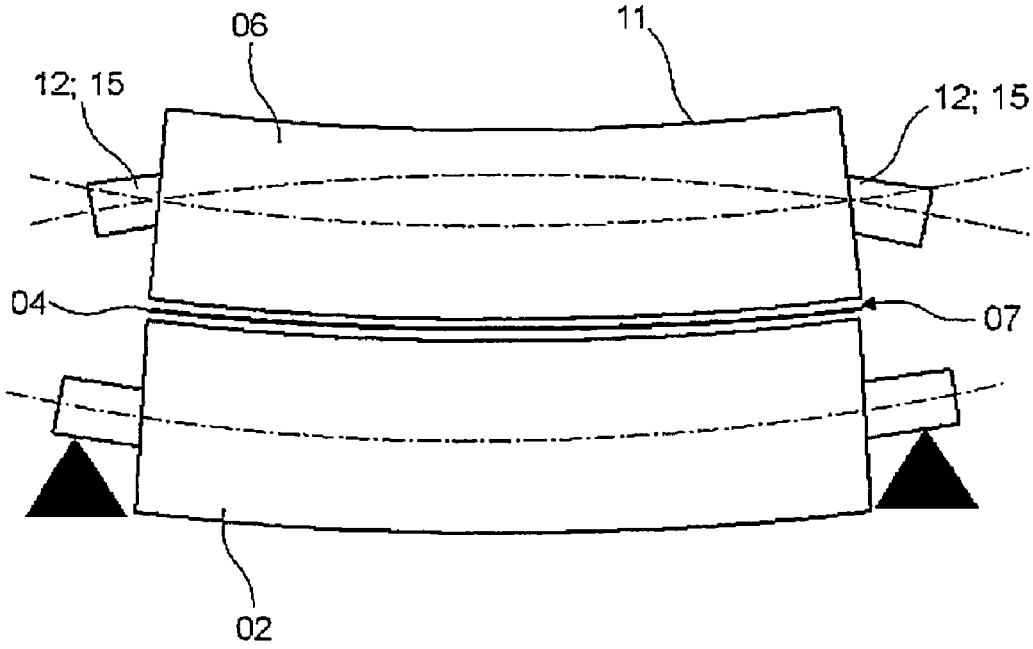
Figure 3:
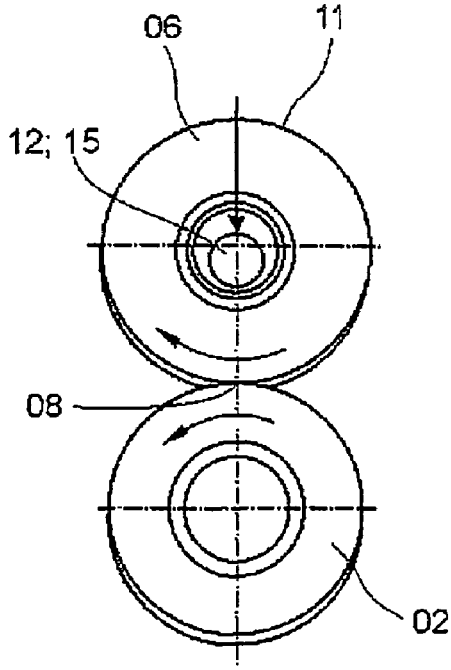

A printing group, which is generally known per se, of a rotogravure printing press, is schematically represented in a side elevation view in FIG. 1. This generally known group consists of a first cylinder 06 and a second cylinder 02, which define a cylinder gap 07, through which a paper web 04 to be imprinted is conducted as the web 04 of material is clamped along a clamping line 08 which clamping line 08 extends perpendicularly with respect to the plane of FIG. 1. The second cylinder 02 is preferably provided with an engraved copper surface. The second cylinder 02 is a forme cylinder 02, which can be easily disassembled, and which is dipped into an ink reservoir 01. Forme cylinder 02 is seated, in a manner not specifically represented, but which is known per se, in a frame, that is not specifically represented in FIG. 1, and is connected with a drive mechanism. A doctor blade 03 for use in removing excess ink, which may be taken along by the forme cylinder 02 from the ink reservoir 01, has been placed against the forme cylinder 02. The first cylinder 06 is a counter-pressure cylinder 06. It is maintained pressed against the forme cylinder 02 and is rotatably driven by the forme cylinder 02 by friction. Because of the effect of the contact pressure exerted by the counter-pressure cylinder 06, as represented by an arrow in FIG. 1, and because of the effect of its own weight, the forme cylinder 02 sags in the center, as shown, in an exaggerated manner, in the elevation view of FIG. 2 and in the lateral view of FIG. 3. In order to exert a uniform pressure over the entire length of the clamping line 08, from one end of the cylinders 02 and 06 to the other, the counter-pressure cylinder 06 must follow the bending of the forme cylinder 02, which bending can be further seen in FIG. 2.

Figure 4:
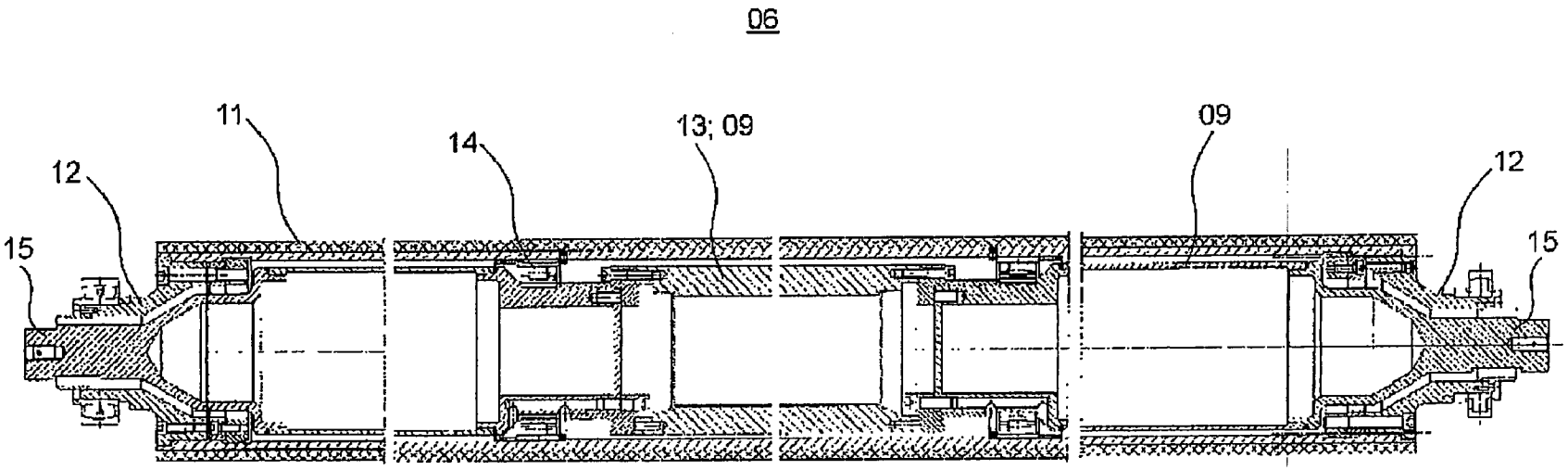

The counter-pressure cylinder 06 is shown in a longitudinal, cross-sectional view in FIG. 4. Counter-pressure cylinder 06 is rotatable around a shaft 09 and has a hollow-cylindrical shell 11. The shell 11 typically has a rubber-covered surface. The shaft 09 is comprised of two opposite shaft end sections 15 and a shaft center section 13. Each one of two hollow journals 12 is connected with the shell 11, is fixed against relative rotation with respect to shell 11, and is rotatably maintained in a frame of the rotogravure printing press, which is not specifically show, by the use of suitable bearings, for example rolling bearings. The shaft center section 13 is extended, via its shaft end sections 15, through the hollow journals 12. Shaft center section 13 supports the center area of the shell 11 via one or several bearings 14, which bearings 14 may be, for example, rolling bearings 14, that are added between shaft center section 13 and the shell 11.

Figure 5:
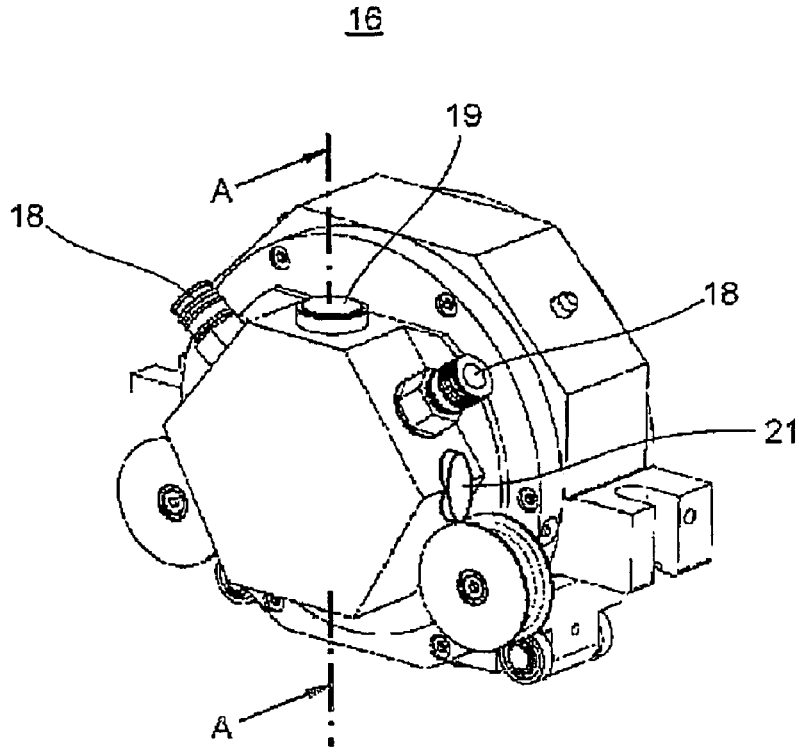
Figure 6:
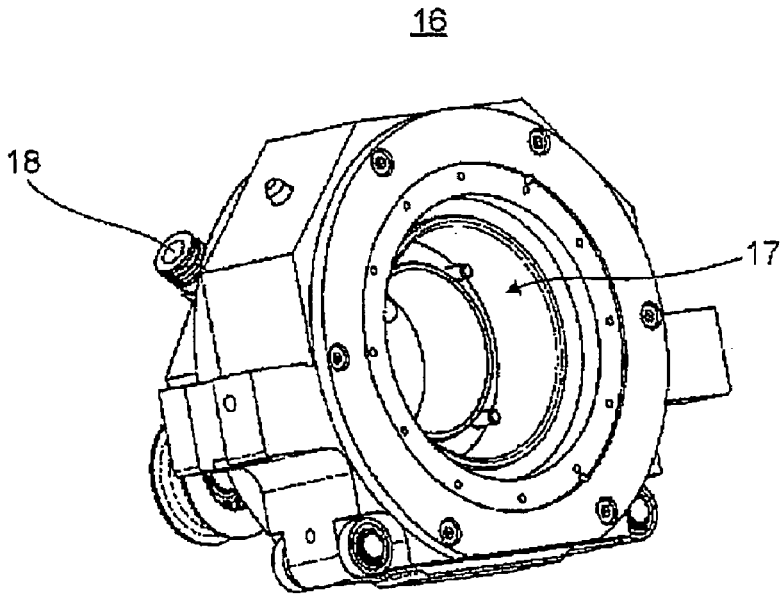
Figure 7:
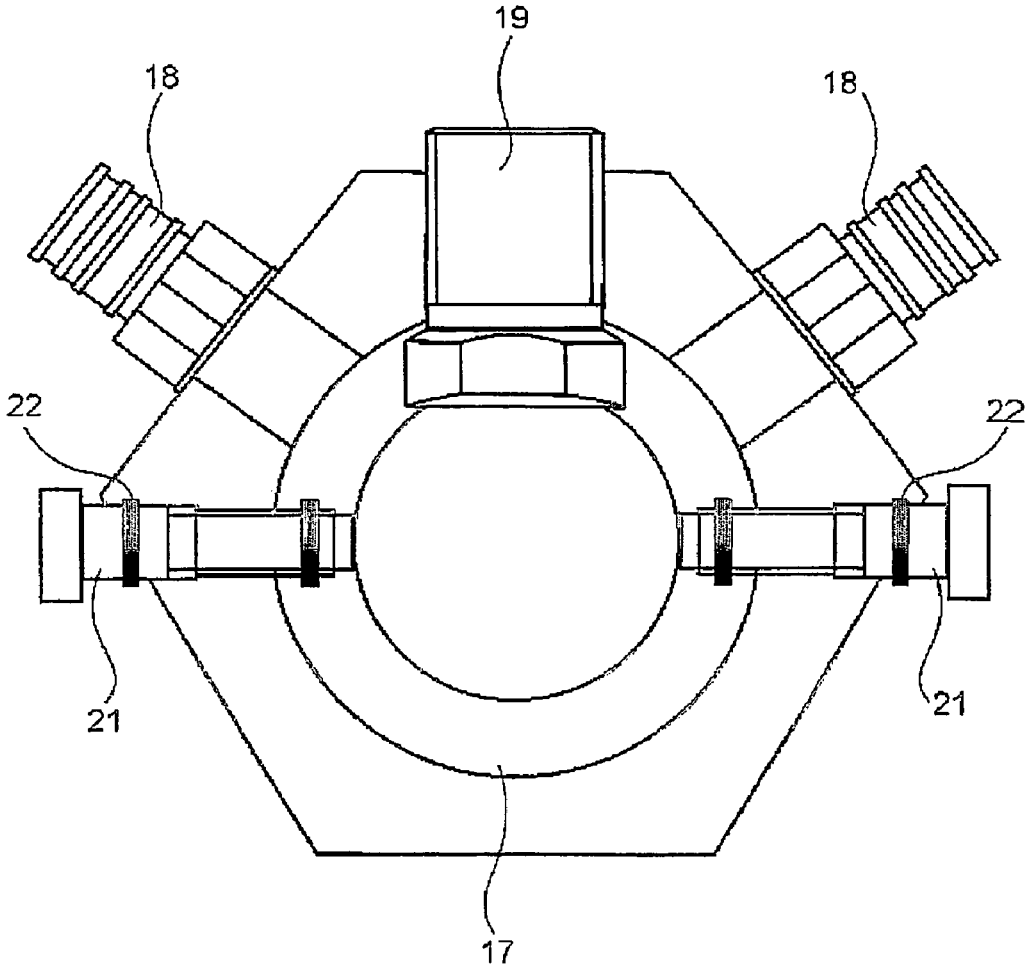

A bearing bushing 16, which is mounted on both sides of the counter-pressure cylinder 06 on the frame, and which is adapted to receive the journals 12, is shown in a perspective representation in FIGS. 5 and 6, and is shown in FIG. 7 in a sectional view that is taken along the line A-A from FIG. 5. The bearing bushing 16 has a recess 17, which recess 17 receives a rolling bearing that is supporting a journal 12, in an area of recess 17 having a large diameter and facing the counter-pressure cylinder 06. In a narrower area, facing away from the counter-pressure cylinder 06, recess 17 in bearing bushing 16 is used for receiving an end section 15 of the center section 13 of the shaft 09, which narrower area of recess 17 can be seen in FIG. 6. Two connectors 18 are used as inflow or outflow connectors for a coolant or for a lubricant, which flows through the counter-pressure cylinder 06 in a circuit along an intermediate space between the center section 13 of the shaft 06 on the one side, and the shell 11 and the journals 12 of the shaft 06 on the other side. The coolant or lubricant is typically a thermal oil which, on the one hand, is used for lubricating the counter-pressure cylinder 06 and, on the other hand, is also used to remove heat which is generated in the course of the operation of the counter-pressure cylinder 06 because of flexing action, and which heat removal aids in the cooling of the counter-pressure cylinder 06.

A tappet 19, which is acting as an actuating member 19, and which is preferably provided in the form of a brass bolt 19, is also provided at the bearing bushing 16 which, hydraulically displaceable, is pressed against the end sections 15 of the shaft's center section 13 which are received in the narrower area of the bearing bushing 16. Next to the tappet 19, two set screws 21, which are arranged diametrically opposite to each other with respect to a center axis of the shaft 09, are provided in the bearing bushing 16 and also act as actuating members. A horizontal force is respectively exerted by each of the set screws 21 on the shaft end sections 13. The tappet 19, as well as the two set screws 21, are all provided with sealing elements 22 at the level of a bore in the wall of the bearing bushing 16 into which they have been inserted. These sealing elements are provided to prevent the escape of the thermal oil from the bearing bushing 16.

For adapting the counter-pressure cylinder 06 to an exterior shape of the bent forme cylinder 02, the tappet 19 exerts a pressure force on the end section 15 of shaft 09 and in this way exerts a vertically directed force on the center section 13 of shaft 09. This actuating force is transmitted, via the rolling bearings 14, to the cylinder shell 11, which, because of this force, can be caused to rest against the sagging forme cylinder 02. The rolling bearings 14 assure that the cylinder shell 11 remains easily rotatable in spite of the considerable pressure and deformation forces. Bearings 14 are preferably configured as cylinder rolling bearings 14 in order to prevent the shell 11 from tilting against the center section 13, which would negatively affect the rotatability of shell 11. In this case, it can be seen that the radial play between the shaft center section 13 and the cylinder-shaped shell 11, i.e. the width of the intermediate space, through which the oil flows, is dimensioned in such a way that, in case of a possibly occurring sagging of the shaft center section 13, because of a force exerted by the action of the tappet 19, no sliding contact between the center section and the shell 11 occurs at any point. In actual use, the distance of this intermediate space is only a few millimeters.

Since the shaft center section 13 only needs to transfer the force supplied by the tappet 19 to the shell 11, a rolling bearing 14, which is arranged in the area of the center of the shell 11, is sufficient. In the preferred embodiment shown in FIG. 4, two rolling bearings 14, which are arranged symmetrically with respect to the shell center, have been provided, and whose mutual spacing distance corresponds to approximately one third of the useful length the shell 11. This makes it possible for the shell 11 to yield a little to a pressure of the forme cylinder 02 in its center area located between the rolling bearings 14.

In addition to the vertical bending of the shell 11 caused by the tappet 19, a horizontal bending of the shell 11 in the running direction or counter to the running direction of the paper web 04 is caused by utilization of the set screws 21. This additional, horizontal bending is usable for compensating for registration errors, which often occur in the course of a printing forme being applied to the circumference of the forme cylinder 02.

Figure 16:
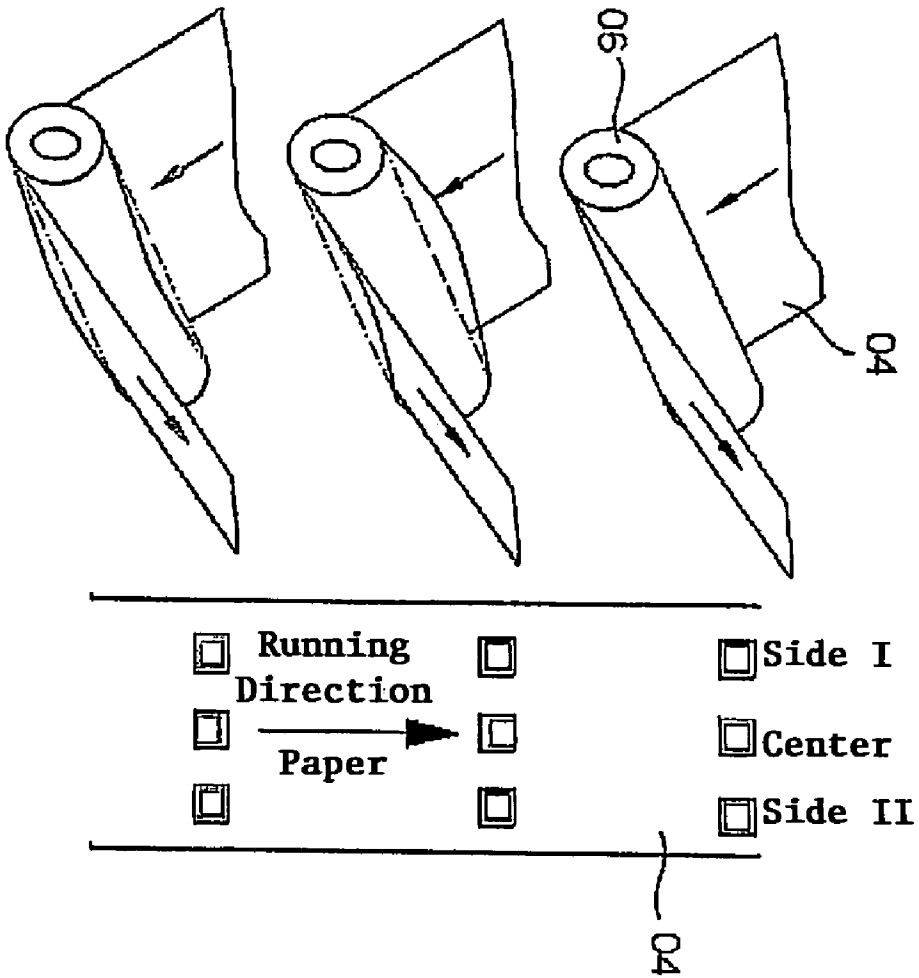
Figure 17:
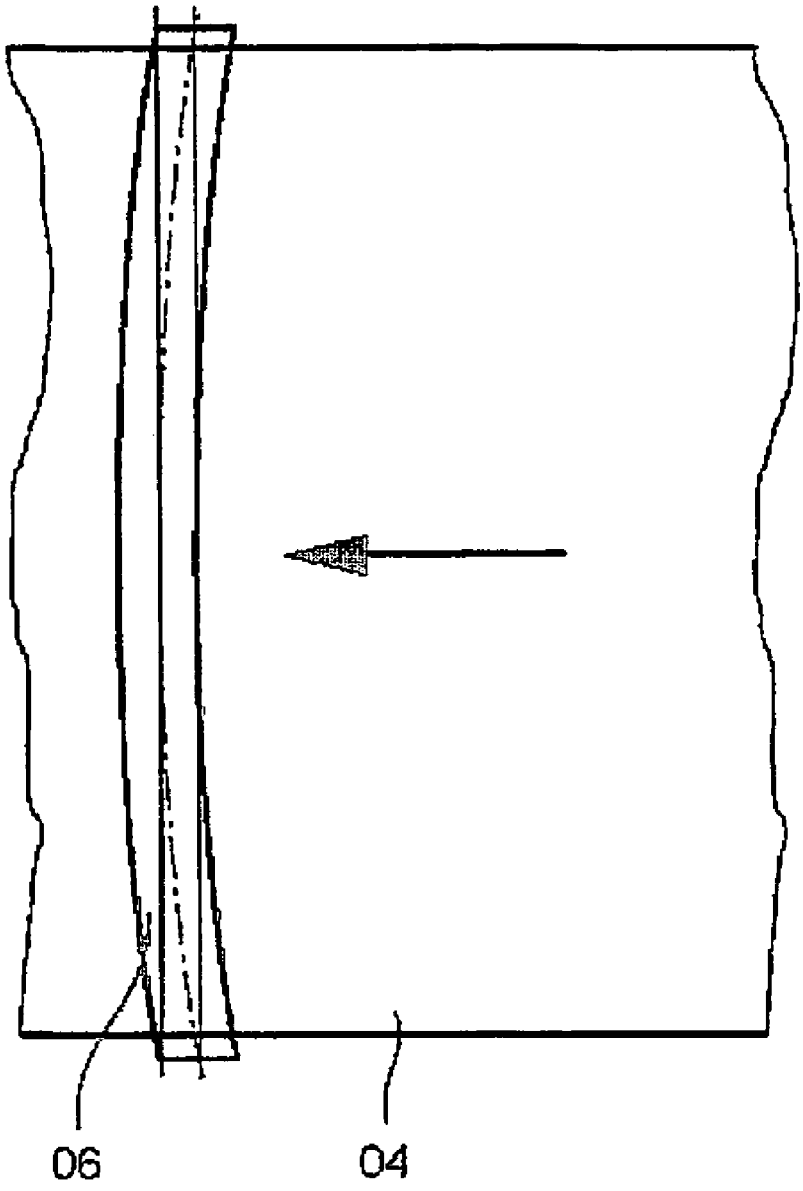

As represented in FIG. 16, several image elements are imprinted on a web of material. Preferably, several first image elements have been imprinted in the axial direction side-by-side in a first printing group, and corresponding second image elements have been imprinted in a second printing group. The depicted cylinder 06, in particular the counter-pressure cylinder 06, is a part of the second printing group. By proper bending of the counter-pressure cylinder 06 in the running direction of the web, or opposite to the running direction of the web of material, the image elements of the second printing group can be displaced in relation to the image elements from the first printing group, either opposite to, or in the web running direction.

The position of the center image elements is changed, in relation to the position of the two outer image elements in response to the bending of the cylinder 06. In another example, which is not specically represented, the web of material has at least four groups of image elements, each of which is imprinted by one printing group.

Figure 8:
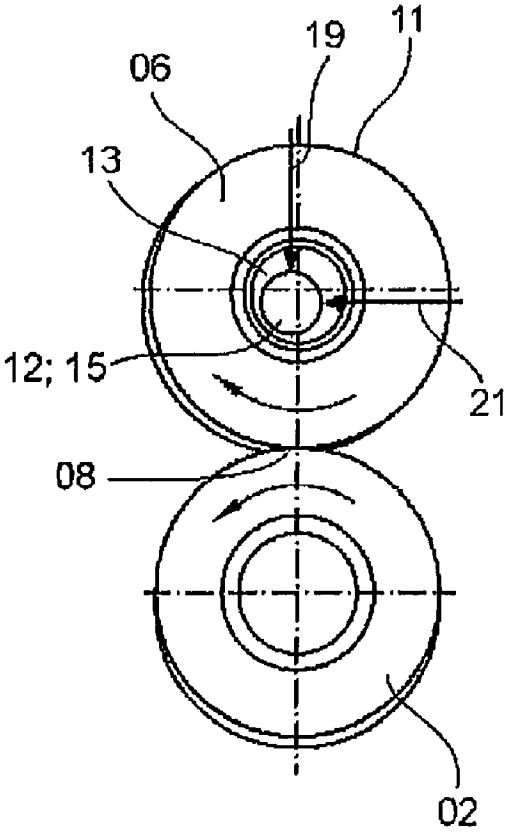

FIG. 8 shows the effects of the superimposition of a vertical force, as exerted by the tappet 19, and of a horizontal force, as exerted by the set screws 21, respectively, as represented in FIG. 8 by arrows identified by 19 or 21, on the end section 15 of the shaft 09. By accomplishing a bending of the shell 11 in the running direction of the paper web 04, a curvature of the clamping line 08, also in the running direction of the paper web 04, takes place. In effect, a shifting of the center area of the shell 11, with respect to the end sections of the shell 11, occurs in a direction which forms an angle with a plane that is extending through the axes of the forme cylinder 02 and the shaft 09, or the shell 11. A corresponding curvature of the clamping line 08 is the result of this.

Figure 9:
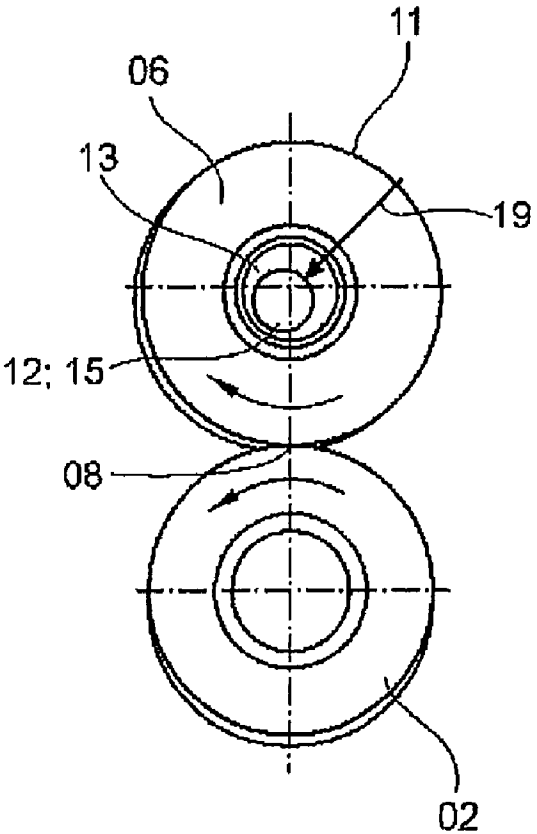

The forces exerted by the tappet 19 and by the set screw 21, in the horizontal direction or in the vertical direction respectively, as seen in FIG. 8 can, of course, be replaced by their resultant. It is also possible to replace the vertical actuating members 19 and the horizontal actuating members 21 with a single actuating member 19, thus causing a shifting in the direction of the resultant, as shown in FIG. 9. For this purpose, the bearing bushing 16 can be mounted on the frame, for example, so that it is rotatable around the axis of the counter-pressure cylinder 06.

In this embodiment, the set screws 21 can be omitted, and the deformation of the counter-pressure cylinder 06 can be realized with only the aid of the tappet 19, whose direction of force application can now be changed by rotation of the bearing bushing 16.

Figures 10, 11:
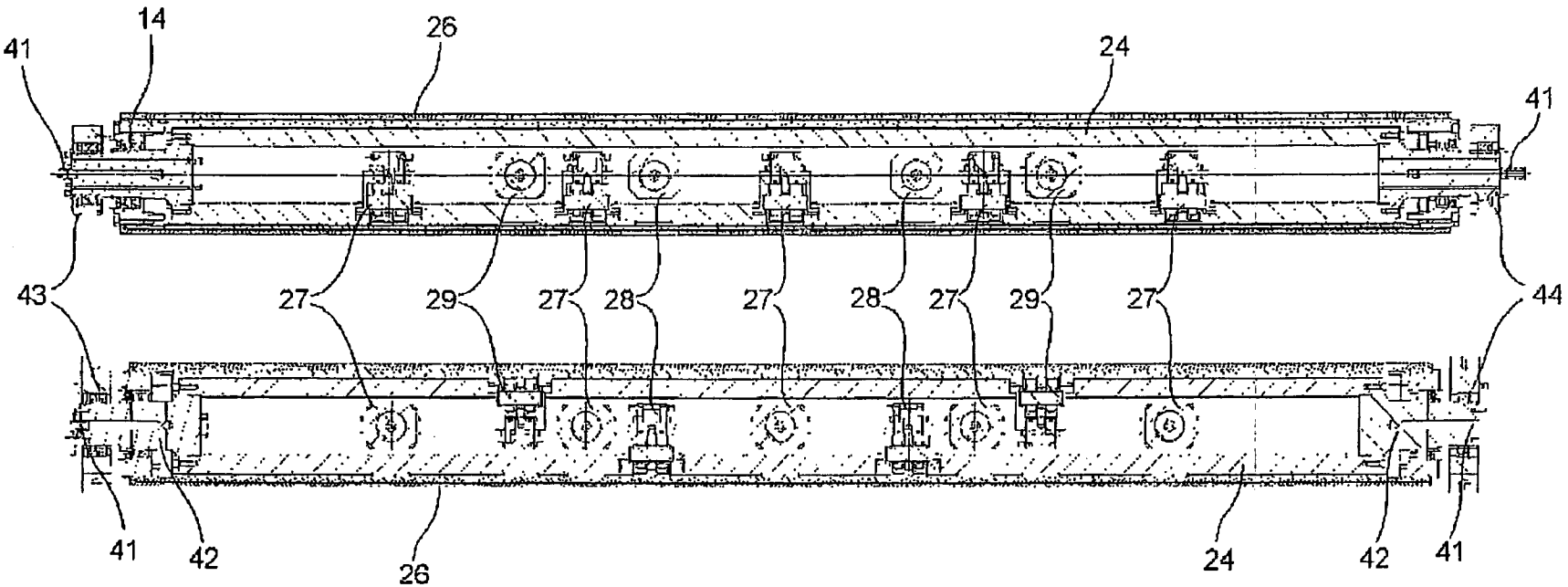

A longitudinal sectional view through a second preferred embodiment of a cylinder 23, namely a counter-pressure cylinder 23, from the side, is shown in FIG. 10, and a longitudinal sectional view through the counter-pressure cylinder 23, in a view from above, is shown in FIG. 11. The counter-pressure cylinder 23 is comprised substantially of a hollow shaft 24, a shell 26, which is rotatably supported at its ends by the use of bearings, for example by the use of rolling bearings, on the shaft 24, as well as by elements 27, 28, 29 for use in creating an inner tension in the counter-pressure cylinder 23. The elements 27, 28, 29 which are embodied as actuating members 27, 28, 29, have been introduced into the interior of the hollow shaft 24 and act, via a ring-shaped or annular gap between the shaft 24 and the shell 26, on the shell 26. The shell 26 is provided with an exterior rubber layer. Journals of the shaft 24, which journals extend past the shell 26 in the axial direction, are seated in a frame, which is not specifically represented, of a rotogravure printing press, in bearings 43, 44, which may be, for example rolling bearings 43, 44. Each rolling bearing 43 is configured as a spherical roller bearing 43 for preventing the tilting of the shaft 24 in the sagging state.

A differentiation of the axially spaced actuating members 27, 28, 29 is made between first actuating members 27, as well as second actuating members 28, 29. The side longitudinal cross-sectional view in FIG. 10 extends through the counter-pressure cylinder 23 in such a way that it intersects the first actuating members 27, while the top plan longitudinal cross-sectional view represented beneath FIG. 10 in FIG. 11 extends through the counter-pressure cylinder 23 in such a way, that it intersects the second actuating members 28, 29. The actuating members 27, 28, 29 are structurally identical and only differ only in their orientation in the hollow shaft 24. The first actuating members 27 are all arranged in a first plane and are all aligned in the same first direction, the second actuating members 28, 29 are arranged in a second plane, which is orthogonal with respect to the first plane. However the actuating members 28 are each aligned in the second plane opposite to the actuating members 29.

Figure 12:
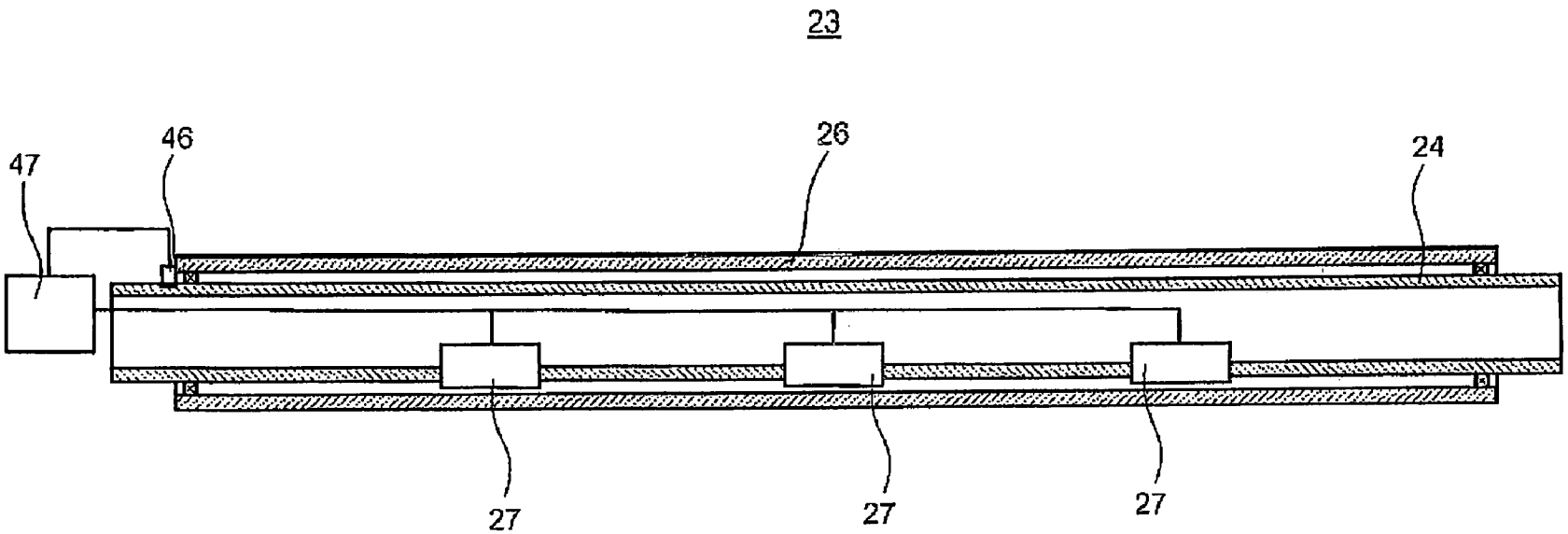

A longitudinal cross-sectional view through the second preferred counter-pressure cylinder 23 is shown, in a simplified way, as a schematic basic sketch in FIG. 12. As can be seen in this representation, the counter-pressure cylinder 23 also includes a vibration sensor 46 and a control unit 47, which control unit 47 is in contact with the vibration sensor 46 and which control unit 47 controls the several actuating members 27, shown by way of example, via a hydraulic connection.

Figure 13:
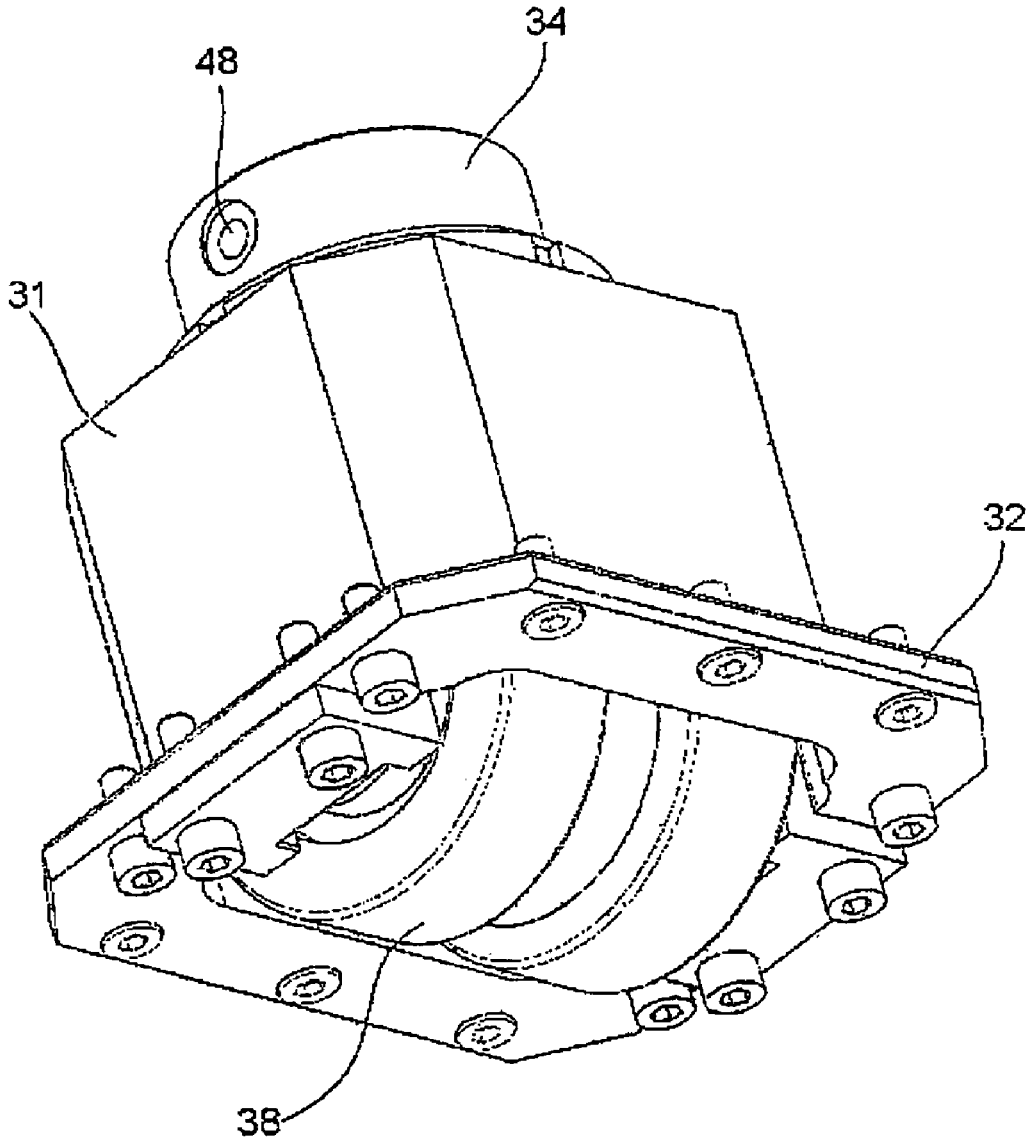
Figure 14:
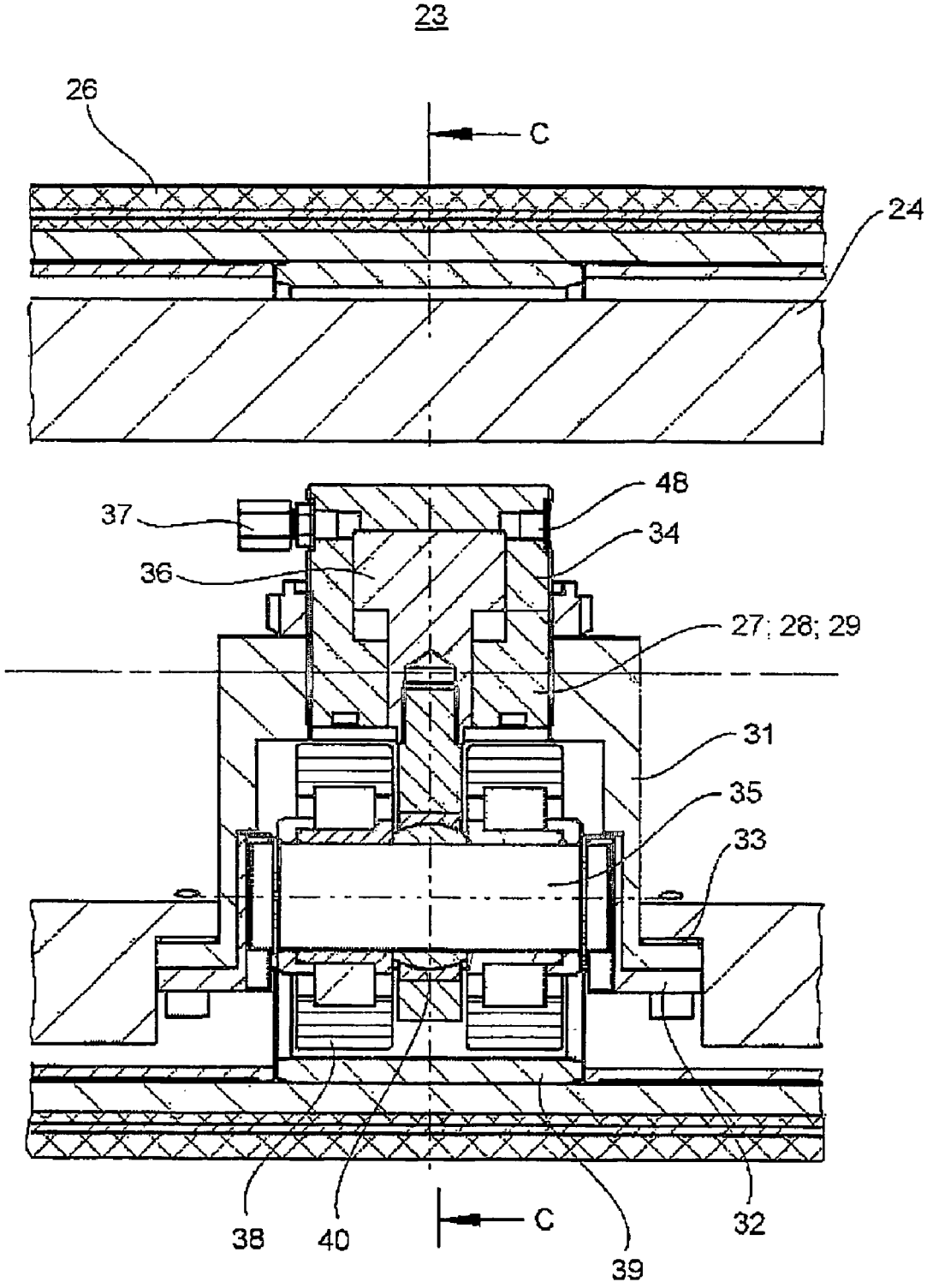

FIG. 13 shows a perspective representation of one of the actuating members 27, 28, 29. In FIG. 14, the arrangement of such an actuating member 27, 28, 29 in the counter-pressure cylinder 23 can be seen, in the form of an enlarged portion of a longitudinal cross-sectional view through the counter-pressure cylinder 23. Finally, FIG. 15 shows a cross-sectional view of the actuating member 27, 28, 29 arranged in the counter-pressure cylinder 23 and taken along the line C-C shown in FIG. 14.

The actuating members 27, 28, 29 each have an angular shaft 31, with a flange 32 formed on it, each of which actuating member 27, 28, 29 each has been inserted, with little play and with the interposition of a seal 33 between the flange 32 and the shaft 24, into a window or aperture of the shaft 24, as seen in FIG. 14. The angular shape of the shaft 31 acts as a twist prevention mechanism for each of the actuators 27, 28, 29. A pressure cylinder 34 has been inserted into the shaft 31, and in whose chamber a piston 36 can be shifted by the action of hydraulic fluid supplied via a hydraulic connector 37. The hydraulic connector 37 is mounted in one of two bores 48 of the hydraulic cylinder, which both terminate in the piston receiving chamber. In actual use, the second bore 48, which is shown unoccupied in FIG. 15, is provided with a blind plug or with a second hydraulic connector 37, from which a pipe line leads to an adjoining actuating member 27, 28, or 29. In this way, the actuating members 27, 28, 29, can be combined into several groups of interconnected actuating members, which actuating members in each group are charged with an identical pressure, which actuating pressure can be independently controlled from group to group.

Each one of the actuating members 27, 28, 29 has been combined, with wheels 38, into a module, each which module can be removed as a unit.

Figure 15:
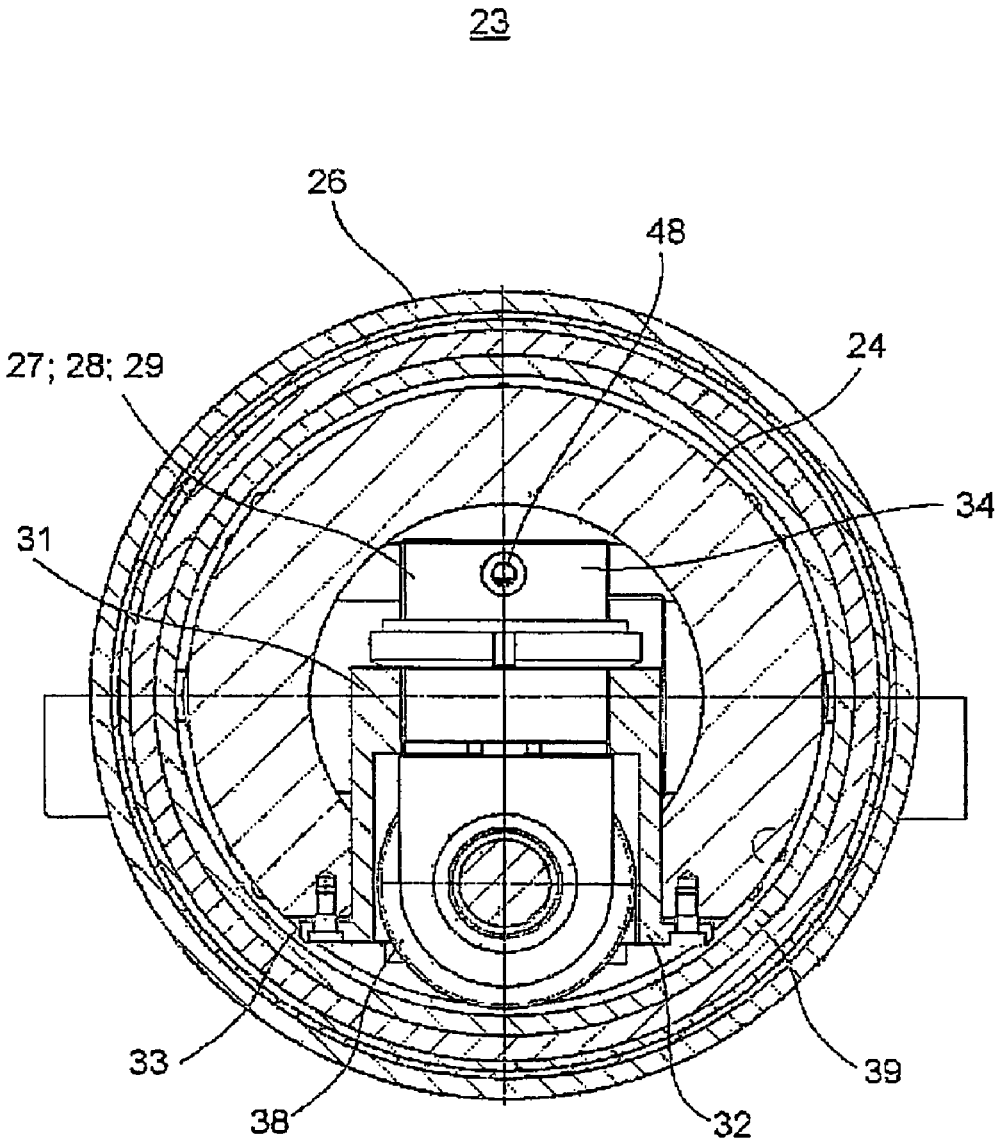

In the embodiment represented in FIGS. 13-15, the piston 36 has two wheels 38, which wheels 38 can be rotated around a common wheel shaft 35 and which together constitute a double roller which is acting as a rolling bearing, which wheels 38, with the piston 36 extended, roll off on a bearing race 39 that is introduced between the shell 26 and the shaft 24, as seen in FIGS. 14 and 15. The wheel shaft 35 is connected with the actuating member 27, 28, 29 via a joint 40, which is embodied as an adjusting bearing 40, for example. Each actuating member 27, 28, 29 has its own, independently movable shaft 35. These shafts 35 are not connected with each other. In the present example, the shaft 35 supports two wheels 38 seated on rolling bearings. In all of the preferred embodiments, the circumference of the wheels lies completely radially outside of the axis of rotation of the shell 26.

When the actuating members, such as actuating members 27, are charged with pressure, they cause a bending of the center area of the hollow shell 26 of the counter-pressure cylinder 23 downward in FIG. 10, or transversely in respect to the plane of FIG. 11. By charging the actuating members 28 or 29 with pressure, it is possible to obtain bending of the shell 26 selectively toward the top or toward the bottom in FIG. 11 or, with simultaneous charging of the actuating members 27, and the members 28 or 29 in a direction obliquely oriented with respect to the planes of intersection of FIGS. 10 and 11. It is also possible to simultaneously charge the oppositely oriented actuating member 27, 28, which opposing actuation does not necessarily lead to bending of the shell 26, but instead leads to a distortion of its cross section into an ellipse.

As can be seen in FIGS. 10 and 11, the shaft 24 has inlets or outlets 41 for a thermal oil on both sides, which thermal oil is used as a coolant or as a lubricant for the counter-pressure cylinder 23. Here, the thermal oil flows through lines 42 in the ring-shaped gap between the shell 26 and the shaft 24. It flows through the counter-pressure cylinder 23 in this gap over the cylinder's entire length and leaves it via corresponding lines 42 and inlets or outlets 41 at its opposite side. The wheels 38 of the actuating members 27, 28, 29 are lubricated in this way, and the thermal oil also removes frictional heat, which heat is generated as a result of flexing action of the shell 26 occurring on an outer rubber layer of the shell 26, as well as on account of friction.

During operation of the rotogravure printing press, the hollow shell 26 of the counter-pressure cylinder 23 rotates around the fixed shaft 24. For generating a uniform pressure over a length of the clamping line 08, between the counter-pressure cylinder 23 and the forme cylinder 02, it is necessary to match the shape of the counter-pressure cylinder 23 to an outer shape of the forme cylinder 02. This is done by use of the actuating members 27, 28, 29. By charging members 27, 28, 29 with hydraulic pressure, the pistons 36 are extended and the wheels 38 are caused to press against the hollow cylinder shell 26, which wheel pressure results in a shifting of the hollow shell 26 with respect to the shaft 24. The outer shape of the shell 26 can thus be adapted to compensate for bending or for other irregularities in the shape of the forme cylinder 02, and the desired pressure distribution in the clamping lines 08 can be realized. Above all, the right-angled arrangement of the first actuating members 27 and of the second actuating members 28, 29 permits bending of the shell 26 at any arbitrary angle, with respect to a plane extending through the axes of the counter-pressure cylinder 23 and the forme cylinder 02 placed against it, and therefore permits the setting of a path length of the web, which is variable in the direction of the width of the web 04, between two fixed points, such as for example between guide rollers situated on both sides of the gap 07.

As previously mentioned, during operation of the counter-pressure cylinder 23, the shell 26 rotates around the shaft 24. In the course of this relative rotation, vibrations of the counter-pressure cylinder 23 occur, which vibrations can build up to greater amounts if the rotation frequency of the shell 26, or if a whole number multiple thereof, corresponds to a resonance frequency of the counter-pressure cylinder 23. The strength of these vibrations is measured by the vibration sensor 46, and the result of the measurement is transmitted to the control unit 47. If the control unit 47 notes an increase of the strength of the vibrations, past a predetermined threshold value, which increase in strength indicates the presence of a resonance, control unit 47 hydraulically triggers the actuating members 27, 28, 29. When these actuating members 27, 28, 29 push against the shell 26, they cause bending of the shell 26 and, to a reduced amount, they also cause bending of the shaft 24. Corresponding to the hydraulic pressure supplied by the control unit 47, a contact pressure, with which respective pistons 36 of each actuating member 27, 28, 29 press against the shell 26, varies, and along with the variance in contact pressure, the inner tension of the shell 26 and of the shaft 24 varies. An increase of the pressure corresponds to a stiffening the counter-pressure cylinder 23, and therefore to an increase in its resonance frequency. If, by changing the contact pressure, the resonance frequency is changed to such an extent that it no longer agrees with the frequency of rotation of the shell 26, the undesired vibrations are reduced.

While preferred embodiments of a cylinder and device for guiding a material web, in accordance with the present invention, have been set forth fully and completely hereinabove, it will be obvious to one of skill in the art that various changes in for example, the specific structure of the forme cylinder, the source of the hydraulic fluid and the like could be made without departing from the true spirit and scope of the present invention which is accordingly to be limited only by the appended claims.

The invention claimed is:

1. A cylinder adapted to contact a web comprising:

first and second spaced cylinder ends and a cylinder body between said first and second cylinder ends, said cylinder body being adapted to print at least one image, in a first image location, on the web egageable with said cylinder body;

a cylinder axis of rotation defined by said first and second spaced cylinder ends and said cylinder body, said cylinder axis of rotation extending transversely to the web-travel direction of a web engagable with said cylinder body;

means supporting said cylinder for rotation in said web-travel direction about said cylinder axis of rotation; and means shifting said first and second spaced cylinder ends and said cylinder body with respect to each other to impose a cylinder bend on said cylinder in one of a direction in, and opposite to said web-travel direction to displace a location of said at least one image element printed on the web engagable with said cylinder body from said first image location to a second image location, different from said first image location, as a function of said imposition of said cylinder bend on said cylinder.

2. The cylinder of claim 1 wherein said cylinder bend is imposed on a center section of said cylinder in said web-travel direction.

3. The cylinder of claim 1 wherein said web of material includes several image elements formed on said web and arranged in said cylinder axis of rotation, said cylinder bend being a function of locations of said image elements.

4. The cylinder of claim 1 wherein said cylinder is a counter-pressure cylinder and further including a forme cylinder cooperating with said counter-pressure cylinder to provide a first printing position for said web of material.

5. The cylinder of claim 4 further including a second printing position for said web of material and spaced in said web-travel direction from said first printing position.

6. The cylinder of claim 1 further including means to set said bend imposed on said cylinder.

7. The cylinder of claim 1 including a shaft supporting said cylinder for rotation about said cylinder axis of rotation, said shaft having first and second shaft end sections and a shaft center section said shaft first and second end sections supporting said cylinder first and second ends, said shaft center section supporting said cylinder body, and further including at least a first actuating member adapted to shift said shaft first and second end sections with respect to said shaft center section in said one of a direction in and opposite to said web-travel direction and perpendicular to a longitudinal axis of said shaft.

8. The cylinder of claim 7 further including a second actuating member, said first and second actuating members shifting said first and second shaft end sections in first and second directions.

9. The cylinder of claim 8 wherein said first and second directions constitute a right angle.

10. The cylinder of claim 8 wherein said first and second shaft end sections extend axially beyond said cylinder and wherein at least one of said actuating members is arranged on one of said shaft end sections outside of said cylinder.

11. The cylinder of claim 1 wherein said cylinder bend is perpendicular to said web travel direction.

* * * * *

UNITED STATES PATENT AND TRADEMARK OFFICE

CERTIFICATE OF CORRECTION

PATENT NO. : 7,255,041 B2
APPLICATION NO. : 10/511444
DATED : August 14, 2007
INVENTOR(S) : Uwe Johann Riedel It is certified that error appears in the above-identified patent and that said Letters Patent is hereby corrected as shown below:

Claim 1, Col. 10, Line 45, after "to," cancel "print at least one image, in" and insert -- engage a web having at least one image element printed on the web at a first image location;--

Col. 10, Lines 46 and 47, cancel in their entirety;

Col. 10, Line 50, after "to" change "the" to --a--; and

Col. 10, Line 51, after "of" change "a" to --the--.

Signed and Sealed this

Thirteenth Day of November, 2007

JON W. DUDAS
*Director of the United States Patent and Trademark Office*